United States Patent [19]

Hultberg et al.

[11] Patent Number: 4,873,925

[45] Date of Patent: Oct. 17, 1989

[54] SPRAY NOZZLE AND VALVE ASSEMBLY

[75] Inventors: Sten Hultberg, Löddeköping; Birger Hansson, Akarp, both of Sweden

[73] Assignee: Jimek International AB, Malmo, Sweden

[21] Appl. No.: 145,327

[22] Filed: Jan. 19, 1988

[51] Int. Cl.[4] ..... B41F 7/30; B41L 25/06

[52] U.S. Cl. ..... 101/147

[58] Field of Search ..... 101/147, 148, 366; 239/93, 101, 556, 585, 583, DIG. 14; 222/409; 118/300, 313

[56] References Cited

U.S. PATENT DOCUMENTS 3,212,715 10/1965 Cocks .
3,329,347 7/1967 Montgomery .
3,764,070 10/1973 Glaser ..... 101/147
4,050,378 9/1977 Smith, Jr. ..... 101/366
4,461,207 7/1984 Washchinsky ..... 101/366
4,527,745 7/1985 Butterfield et al. .

*Primary Examiner*—J. Reed Fisher
*Attorney, Agent, or Firm*—Burns, Doane, Swecker & Mathis

[57] ABSTRACT

A sprayer assembly comprises a nozzle section and a valve section. The nozzle section includes a valve housing having a valve element at its front end defining a spray outlet, and a valve seat inserted into its rear end. The valve section includes a plunger reciprocably mounted in a solenoid, and a valve stem mounted coaxially in a front end of the plunger for engaging the valve seat. The valve stem can be replaced by removing the valve section and pulling the stem out of the plunger.

14 Claims, 6 Drawing Sheets

Fig. 8
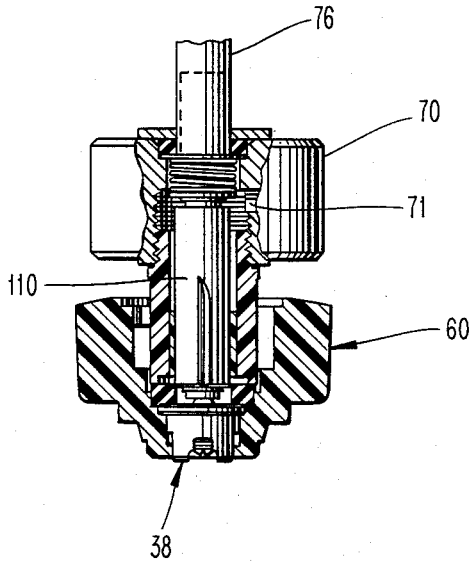
Fig. 10
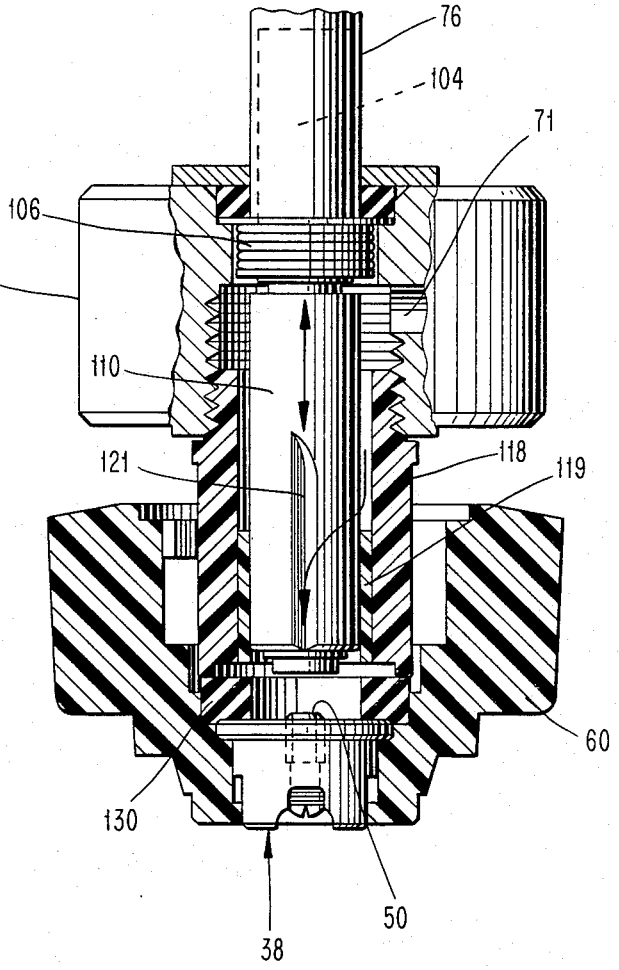
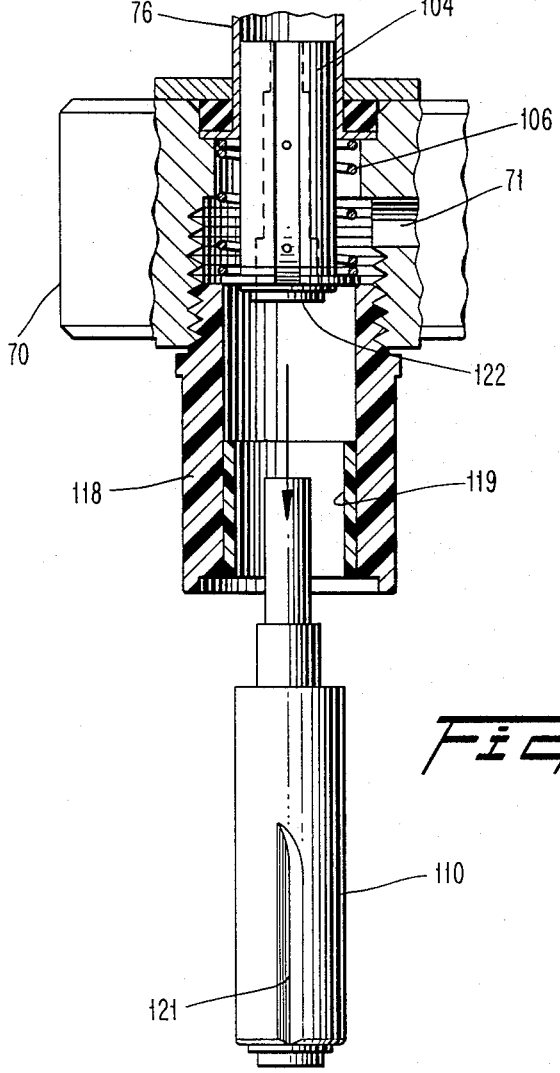
Fig. 9

SPRAY NOZZLE AND VALVE ASSEMBLY

BACKGROUND OF THE INVENTION

The present invention relates to a liquid sprayer apparatus, especially of the type utilized in a pulsed spray dampener system.

Various systems have been proposed in the past for applying a fluid to the rollers of printing presses. These fluids may be used, for example, for dampening or cleaning the rollers, or for preventing printing offset. One type system dampens the rollers by spraying a fluid most from nozzle assemblies positioned adjacent the rollers. Typically, a plurality of nozzle assemblies are aligned in a spray bar.

A nozzle assembly which has heretofore been employed is described later in this text in detail in connection with FIGS. 11–13. Briefly, that sprayer assembly is characterized by a nozzle section and a valve having a plunger positioned at an appreciable distance behind the nozzle section. Pressurized fluid is supplied to the valve and is directed to a sump when the valve is closed and to the nozzle section when the valve is open. The plunger is reciprocated by a solenoid to produce a pulsating spray.

When the front sealing face of the plunger becomes worn, it is necessary to disassemble the solenoid mechanism in order to replace the plunger. This is a time-consuming task which must periodically be performed on all of the nozzle assemblies. Moreover, the need to conduct fluid to a sump when the valve is closed results in wasted fluid which must be disposed of. On the other hand, it has been found that if the feature of conducting pressurized fluid to a sump is eliminated, there will occur, upon opening of the valve, an excessive pressurizing of residual fluid remaining in the passage between the nozzle element and the valve plunger which can result in an excessive amount of fluid being sprayed, as well as a dripping of fluid after the valve has been closed. However, by conducting the pressurized fluid to a sump, no pressure build-ups will occur.

Therefore, it would be desirable to provide a sprayer assembly in which the sealing face can be replaced with minimal time and effort, no excessive pressure build-ups occur, and there is no need to dispose of unused liquid.

SUMMARY OF THE INVENTION

In accordance with the present invention, a liquid sprayer assembly comprises a valve and a nozzle releasably mounted to the valve. The nozzle includes a liquid outlet at a front end thereof and a valve seat at a rear end thereof. The valve comprises a valve housing including a throughbore communicating with a liquid inlet. A solenoid plunger is slidably mounted in the throughbore for reciprocable movement therein. A valve stem is removably mounted at a front end of the plunger and includes a front sealing surface arranged to contact the valve seat. The valve seat, the valve stem, the plunger, and the nozzle are coaxially arranged. The throughbore is wide enough to permit forward removal of the valve stem from the plunger when the nozzle is removed from the valve. Accordingly, only minimal disassembly of the apparatus is required in order to replace the sealing surface. The presence of the valve seat directly in the valve nozzle prevents the occurrence of excessive pressure build-ups in the liquid being sprayed.

BRIEF DESCRIPTION OF THE DRAWINGS

The objects and advantages of the invention will become apparent from the following detailed description of preferred embodiments thereof in connection with the accompanying drawings, in which like numerals designate like elements, and in which:

FIG. 8 is a fragmentary longitudinal sectional view taken through the sprayer assembly when the nozzle section is closed by the valve stem;

FIG. 9 is a fragmentary exploded longitudinal sectional view taken through a valve section of the sprayer assembly depicting the valve stem being removed from the plunger;

FIG. 10 is a view similar to FIG. 8 with the valve stem in a retracted position to emit fluid flow to the nozzle;

DETAILED DESCRIPTION OF PREFERRED EMBODIMENTS OF THE INVENTION

Figure 1:
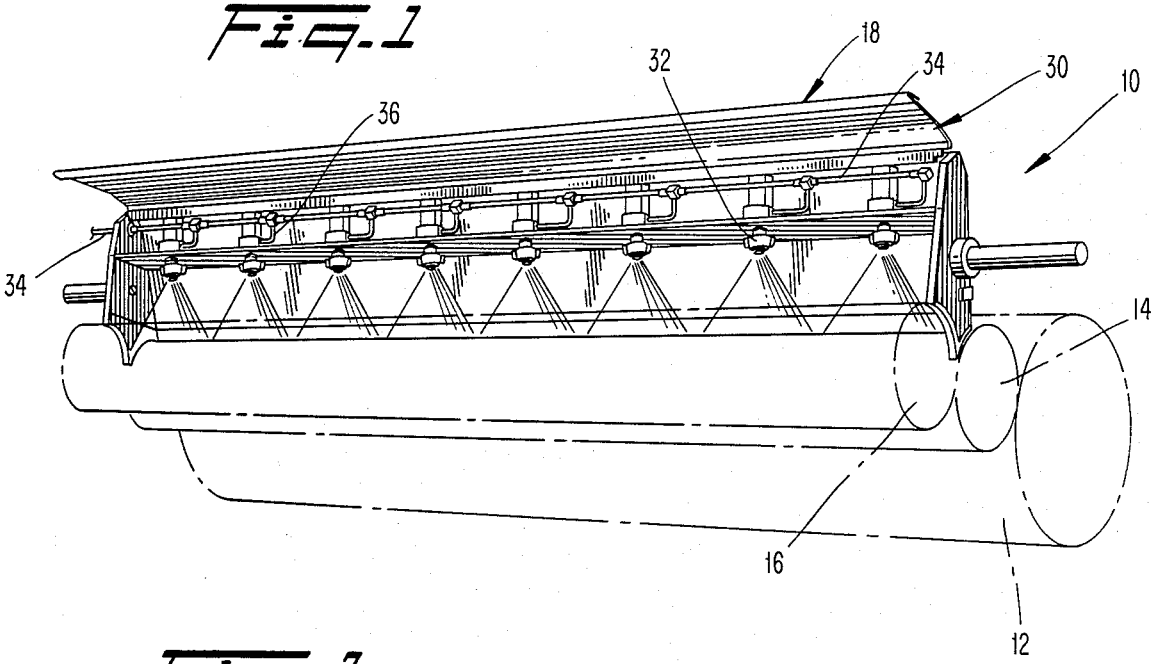
FIG. 1 is a perspective view of a spray mechanism according to the present invention, with portions of a printing mechanism depicted in phantom.
Figure 2:
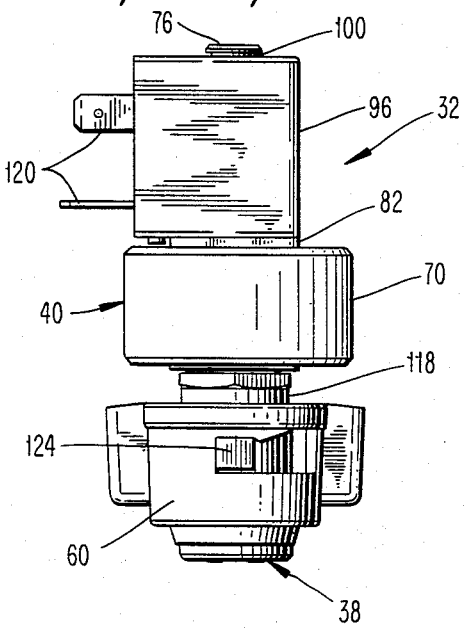
FIG. 2 is a side elevational view of a sprayer assembly according to the present invention.
Figure 3:
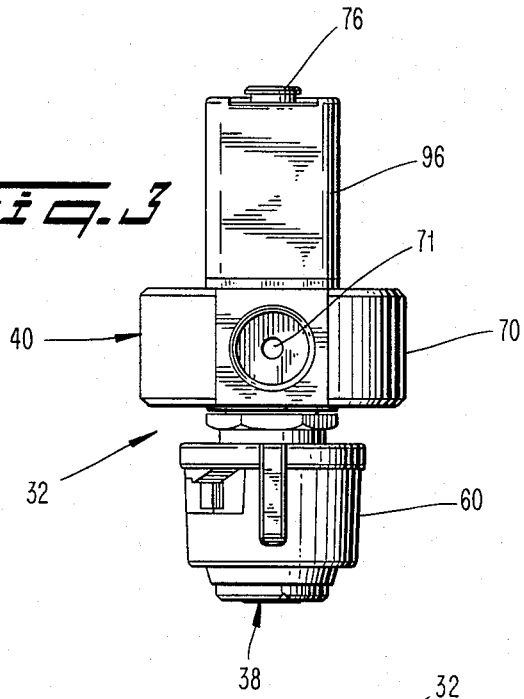
FIG. 3 is a view similar to FIG. 2 displaced ninety degrees therefrom.
Figure 4:
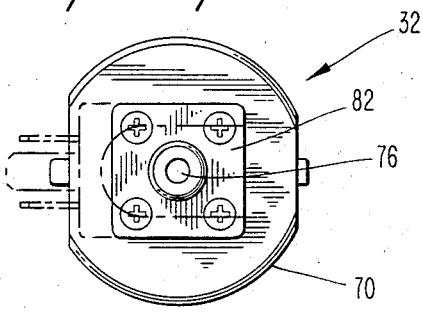
FIG. 4 is a rear end view of the sprayer assembly, with a solenoid casing thereof depicted in phantom lines.
Figure 5:
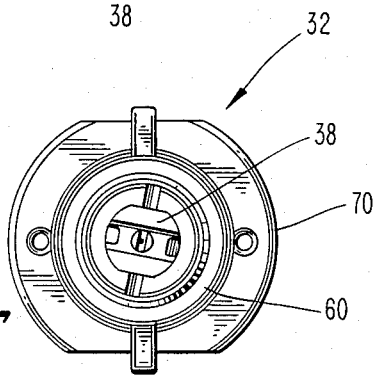
FIG. 5 is a front end view of the sprayer assembly.

Depicted in FIG. 1 is a portion of an offset printing apparatus 10 comprising a plate cylinder roll 12, a water-form roll 14, a dampening roll 16, and a spray dampener mechanism 18 according to the present invention. The spray dampener mechanism 18 emits a pulsating spray of wetting liquid, such as water which may contain certain additives, the liquid being sprayed onto the dampener roll and from there transferred to the water-form roll.

The dampener mechanism comprises a housing 30 upon which are mounted a plurality of sprayer assemblies 32. Those sprayer assemblies 32 are connected in parallel with a fluid inlet conduit 34 for receiving pressurized wetting liquid by means of separate take-off lines 36 leading from the inlet conduit 34 to the respective nozzle assemblies 36.

Figure 7:
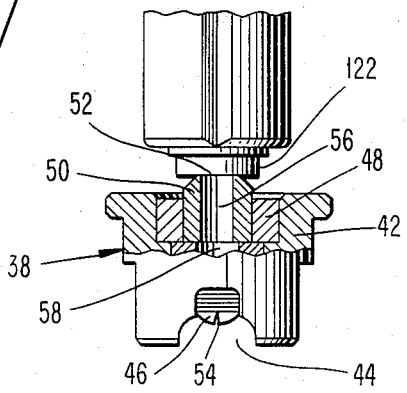
FIG. 7 is a fragmentary view of a nozzle section being sealingly engaged by a valve stem, with portions of the nozzle section being broken away.

Each sprayer assembly 32 comprises a nozzle section 38 and a valve section 40. The nozzle section 38 comprises a generally cylindrical nozzle housing 42 (FIG. 7) which includes a transverse slot 44 at its front end. Mounted by press-fit within a center bore of the nozzle housing 42 is a nozzle element 46, preferably formed of hard, wear-resistant material such as tungsten carbide. Press-fit into a rear end of the center bore is a retaining ring 48, and press-fit into a center hole of the ring 48 is a valve seat 50. The valve seat is of generally hollow cylindrical shape and includes a tapered end 52. The nozzle element 46 includes a slit 54 in its front end, which slit communicates with a center passage 56 of the valve seat 50 through a center passage 58 in the nozzle element 46.

Figure 6:
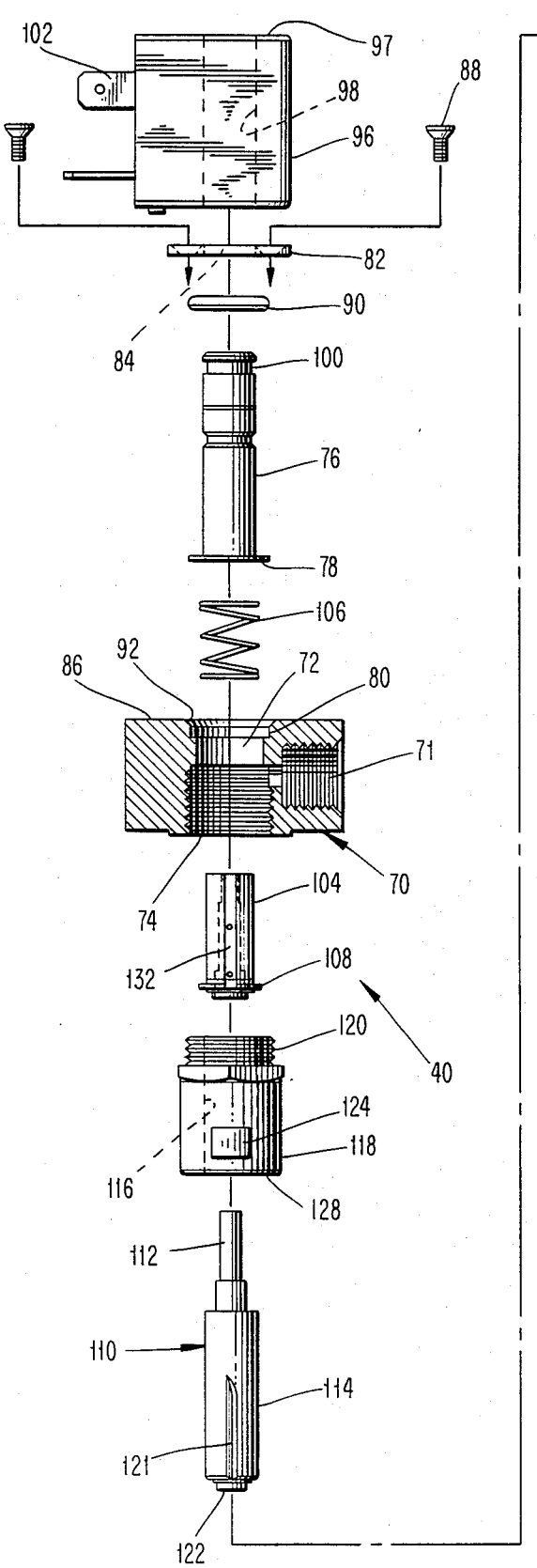
FIG. 6 is an exploded longitudinal sectional view of the sprayer assembly.
Figure 6:
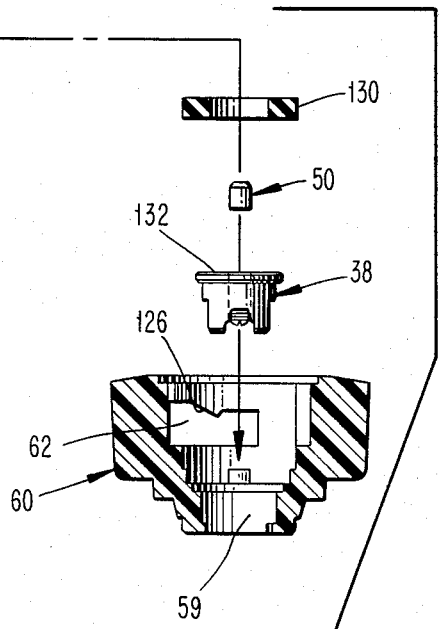

The nozzle housing 42 is removably disposed in the front end of a throughbore 59 formed in a cap 60 (FIG. 6) of the type described in U.S. Pat. No. 4,527,745. The cap 60 includes slots 62 in its outer wall for reasons to be explained hereinafter.

The valve section 40 (FIG. 6) comprises a valve housing 70 which includes a through-bore 72, a front end of which containing an internal thread 74. A liquid, such as a dampening solution, is supplied to the valve housing 70 by means of a port 71 which may be threaded to receive a correspondingly threaded conduit. Removably attached to a rear end of the valve housing is a hollow post 76. The post 76 includes an enlarged flange 78 at its front end which fits into a counterbore 80 located at a rear end of the throughbore 72. A plate 82 has a central opening 84 through which the post 76 passes, the plate 82 being attached to the rear side 86 of the valve housing 70 by means of screws 88. A resilient seal ring 90 is disposed between the plate 82 and the flange 78 to engage a flared rear end 92 of the counterbore 80 in order to create a fluid seal therewith.

Mounted on a rear end of the post 76 is a conventional plug-in type solenoid coil casing 96. That casing includes a bore 98 through which the post 76 extends. An annular external groove 100 is formed at the rear end of the post 76 to receive a retaining ring (not shown) or the like for retaining the casing 96 on the post. A spring (not shown) may be disposed between such retaining ring and a rear surface 97 of the casing to bias the casing against the plate 82. The spring would be yieldable to permit the casing to be displaced slightly away from the plate 82 in order to be rotated about the axis of the post 76 so that the three plug-in prongs 102 could be repositioned.

The post 76 has a hollow front end into which a valve plunger 104 is slidably disposed so as to be positioned within the solenoid coil casing 96. The plunger is adapted to be displaced rearwardly (i.e., upwardly as viewed in FIG. 6) in response to energization of the solenoid coil contained within the casing 96. A coil compression spring 106 surrounds the plunger 104 and acts between the flange 78 and a flange 108 situated at a front end of the plunger 104. The flange 108 may be formed by a split retaining ring for example. Thus, when the plunger is retracted rearwardly by the solenoid coil, the spring 106 is compressed.

Removably mounted in a front hollow end of the plunger is a valve stem 110. The valve stem 110 includes a rear portion 112 mounted by friction-fit within the plunger 104, and a front portion 114 of enlarged cross-section which slides within a throughbore 116 of a body member 118. The body member includes external threading 120 on its rear end which is screwed into the internal threading 74 of the valve housing. The body member 118 includes an internal bushing 119 within which a front end of the valve stem 110 slides. The valve stem includes a plurality of longitudinal channels 121 in its outer periphery for conducting liquid forwardly past the bushing 119 (see FIG. 10).

Projecting from the front end of the stem 110 is a disc 122 formed of a resilient material. The disc 122 is of larger diameter than the rear end of the passage 56 formed in the valve seat 50 and is adapted to bear sealingly there-against under the bias of the spring 106. It will be appreciated that the passages 56, 58, the stem 114, the plunger 104, and the post 76 are aligned along a common longitudinal axis.

The stem 110 is no larger in cross-section than the throughbore 116 of the body 118, whereby the stem 114 can be pulled out of the plunger 104 and completely out of the sprayer assembly 32 in a forward direction after the cap 60 and nozzle section 38 have been removed therefrom. Such pulling out of the stem is achieved in response to the application of a longitudinal force to the front end of the stem of suitable magnitude for overcoming the frictional forces retaining the stem.

Instead of being mounted by friction-fit, the stem could be attached to the plunger by other quick-release connections such as a threaded connection, whereby the stem would be removable in response to a rotary force being applied to a front end of the stem.

Attachment and removal of the nozzle section 38 is effected by the cap 60 in a conventional manner. That is, the slots 62 in the cap are arranged to receive radially projecting lugs 124 formed on the outer wall of the body 118. The side walls of the slots 62 include cam portions 126 which serve to draw the cap toward the body 118 in response to relative rotation therebetween. This causes the front wall 128 to be forced longitudinally against an elastic seal ring 130 positioned between the front wall 128 and a rear wall 132 of the nozzle housing 42. Counter-rotation of the cap is yieldably resisted by thus-compressed ring 130. The ring 130 also creates a fluid seal once it has been compressed in that fashion.

IN OPERATION, pressurized liquid is introduced to the sprayer assembly through the port 71. If the solenoid is de-energized, i.e., in a non-spraying mode, the valve stem is biased against the valve seat 50 to close the nozzle element. Once the solenoid has been actuated, the plunger and stem are retracted, thereby unblocking the valve seat. Pressurized liquid is immediately ejected through the valve outlet 54 and onto the roll. After the sealing disc 122 has become worn, removal thereof is achieved by simply unscrewing the body member 118 and pulling the stem 110 axially from the plunger. Insertion of a new stem is achieved by reversing those steps.

Prior Art Nozzle Assembly

The present invention offers significant advantages over a nozzle assembly previously employed in spray dampeners. Such a prior art nozzle assembly 236, depicted in FIGS. 11–13, comprises a nozzle section 238 and a valve section 240. The nozzle section 238 comprises a generally cylindrical nozzle housing 242 which includes a transverse slot 244 at its front end. Mounted by press-fit within a center bore of the nozzle housing 242 is a nozzle element 246, preferably formed of a hard, wear-resistant material such as tungsten carbide. Press-fit into a rear end of the center bore is a retaining ring 248. The nozzle element 246 includes a slit 254 in its front end, which slit communicates with a center passage 258 in the nozzle element 246. The nozzle housing 238 is removably disposed in the front end of a throughbore formed in a cap 260 (FIG. 12) of the type described in U.S. Pat. No. 4,527,745. The cap 260 includes slots 262 in its outer wall for reasons to be explained hereinafter.

The valve section 240 comprises a valve housing 270 which includes first and second threaded bores 271, 272 separated by a partition 273. The bores 271, 272 are aligned with each other and with the passage 258 in the nozzle housing 242. Disposed in the valve housing 270 perpendicularly to the bores 271, 272 is a third bore 274. That third bore 274 communicates with the first and second bores 271, 272 by first and second passages 275A, 275B, respectively. Removably attached to a rear end of the valve housing is a hollow post 276. The post 276 includes an enlarged flange 278 at its front end which fits into a counterbore 280 at a rear end of the third bore 274. A plate 282 has a central opening 284 through which the post 276 passes, the plate 282 being attached to the rear side 286 of the valve housing 270 by means of screws 288. A resilient seal ring 290 is disposed between the plate 282 and the flange 278 to engage a flared rear end 292 of the counterbore 280 in order to create a fluid seal therewith.

Mounted on a rear end of the post 276 is a conventional plug-in type solenoid coil casing 296. That casing includes a bore 298 through which the post 276 extends. An annular external groove 300 is formed at the rear end of the post 276 to receive a retaining ring (not shown) or the like for retaining the casing 296 on the post. A spring (not shown) may be disposed between such retaining ring and the rear side 297 of the casing to bias the casing against the plate 282. Such spring would be yieldable to permit the casing to be displaced slightly away from the plate 282 in order to be rotated about the axis of the post 276 so that the three plug-in prongs 302 could be repositioned.

The post 276 has a hollow front end into which a valve plunger 304 is slidably disposed so as to be positioned within the solenoid coil casing 296. The plunger is adapted to be displaced rearwardly (i.e., to the right in FIG. 12) in response to energization of the solenoid coil contained within the casing 296. A coil compression spring 306 surrounds the plunger 304 and acts against the flange 278 and a flange 308 situated at a front end of the plunger 304. The flange 308 may be formed by a split retaining ring for example. Thus, when the plunger is retracted rearwardly by the solenoid coil, the spring 308 is compressed to bias the plunger forwardly.

Disposed in a front end of the plunger 304 is an elastic sealing member 310 which is adapted to bear against a tapered seat 312 surrounding the passage 275A under the bias of the spring 306 whenever the solenoid coil is not energized. In so doing, the passage 275A will be closed, while the passage 275B will remain open.

The plunger 304 includes at least one longitudinal channel 314 which is adapted to conduct a flow of fluid from the passage 275B to the rear end of the hollow post 276. Such fluid would flow around an outer edge of the flange 308, though the channel 314 and through a small hole (not shown) at the rear of the post 276 and from there to a suitable conduit (not shown) connected to the rear end of the post 276.

Threadedly attached to the first bore 271 is a hollow body member 318 on which the nozzle housing 242 is to be mounted by means of the cap 260. In that regard, the slots 262 in the cap are arranged to receive radially projecting lugs 324 formed on the outer wall of the body 318. The side walls of the slots 262 include cam portions 326 which serve to draw the cap toward the body 318 in response to relative rotation therebetween. This causes a front wall of the body member 318 to be forced longitudinally against an elastic seal ring (not shown) positioned between the front wall and a rear wall of the nozzle housing 242.

Figure 11:
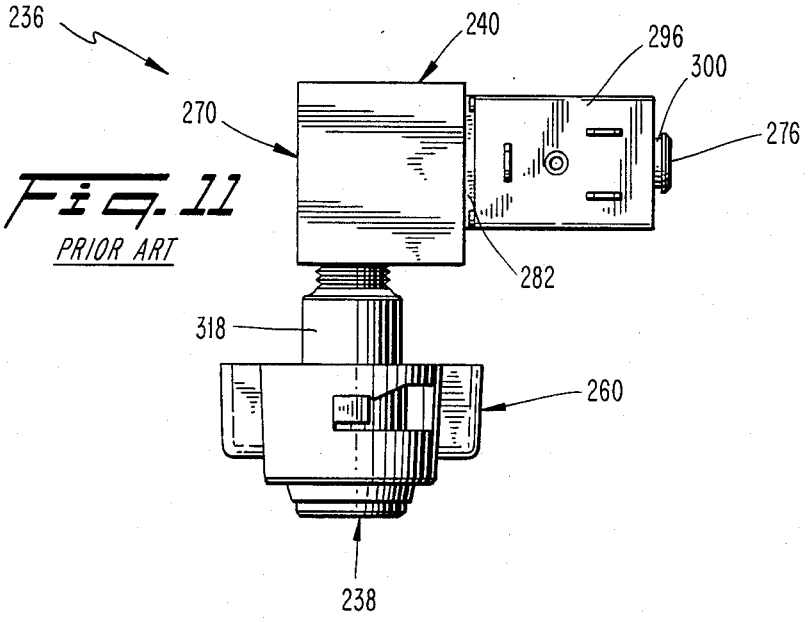
Fig. 11 PRIOR ART
FIG. 11 is a side elevational view of a prior art sprayer assembly.
Figure 12:
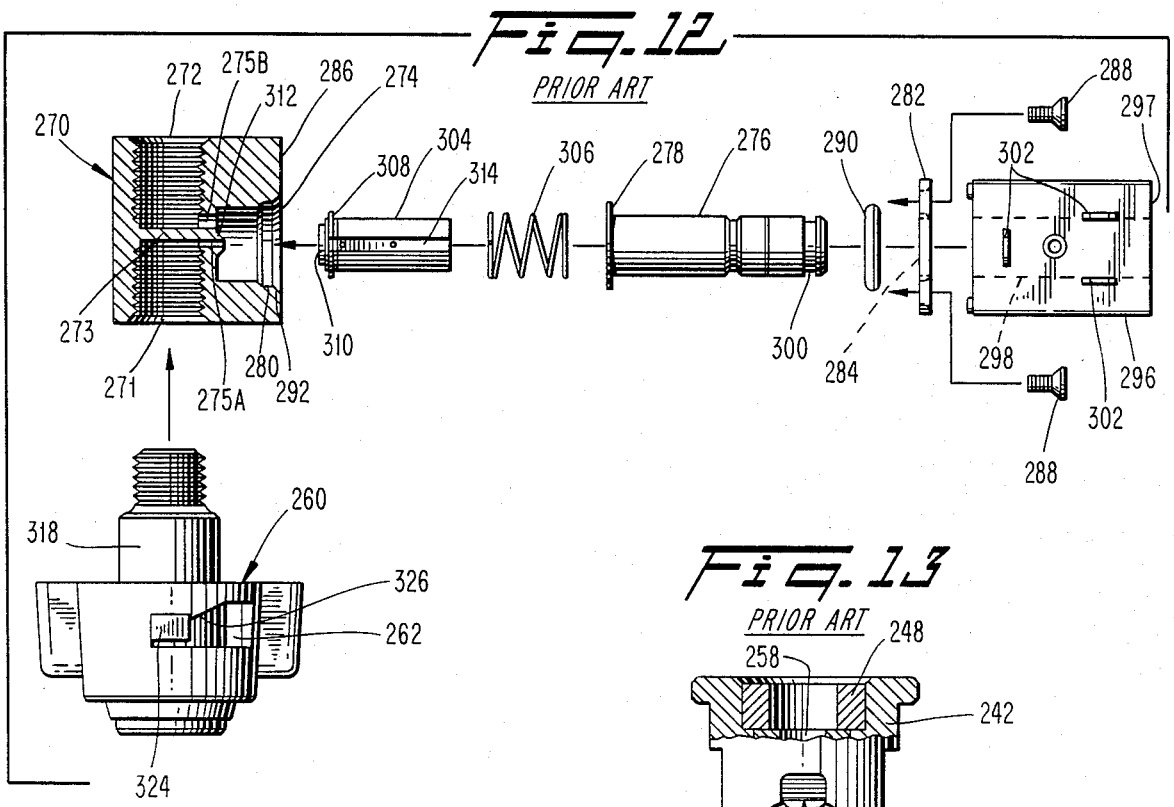
Fig. 12 PRIOR ART
FIG. 12 is an exploded view of the prior art sprayer assembly with portions thereof in longitudinal section.
Figure 13:
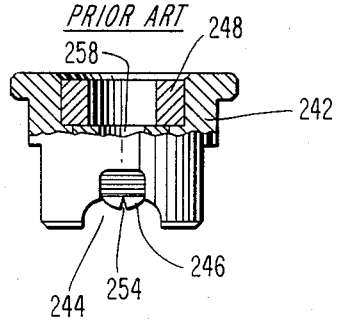
Fig. 13 PRIOR ART
FIG. 13 is a side elevational view, with portions broken away, of a prior art nozzle section.

In operation of the prior art apparatus disclosed in connection with FIGS. 11–13, pressurized fluid is delivered to the second bore 272 and flows through the passage 275B. If the solenoid is not energized, the valve plunger 304 closes the passage 275A, so that the fluid travels through the channel 314 and out the rear end of the post 276 to a suitable sump. If the valve is energized, causing the plunger 304 to be retracted, the passage 275A is opened, enabling fluid to flow therethrough and from there to the nozzle element. When the plunger is retracted, a seal at the wall 330 of the plunger engages the small hole (not shown) at a rear end of the plunger to close the flow to the sump.

Advantages of the Present Invention

It will be appreciated that a sprayer assembly according to the present invention enables a worn valve stem, to be replaced by merely unscrewing the body member 118 and pulling forwardly on the stem 110 with a force sufficiently strong to overcome the resistance of the friction-fit of the stem portion 112 within the plunger 104. A new stem can then be inserted by being pushed into the plunger. Therefore, no appreciable disassembly of the valve assembly is required.

Furthermore, by providing a push-in, friction-fit valve seat 50 for the rear end of the nozzle element, a conventional prior art nozzle section can be converted into a nozzle section suitable for use in the present invention. Such an arrangement enables fluid flow to be terminated directly at the rear side of the nozzle section. The short distance between the valve and the spray slit 54 avoids the occurrence of pressure surges and dripping, and avoids the need to divert unused pressurized fluid to a sump when the valve is closed. Hence, there is no need to dispose of large amounts of unused liquid.

Figure 14:
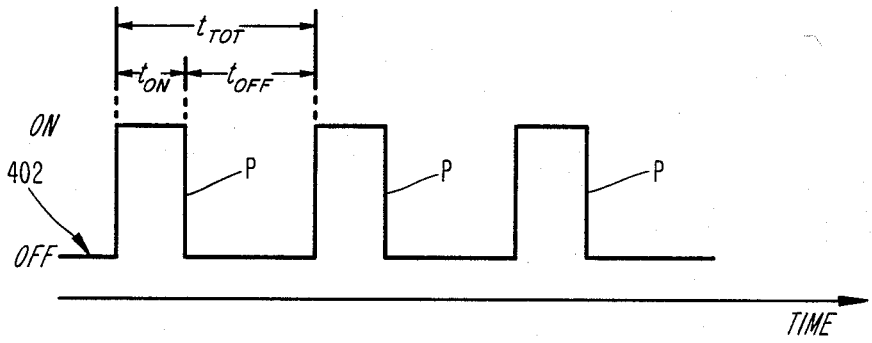
FIG. 14 illustrates a rectangular pulse sequence used for actuating a spray nozzle solenoid.

Referring now to FIG. 14, a signal 402 includes a sequence of rectangular pulses P and may be used for controlling actuation of the spray nozzle solenoids. Briefly, when the signal 402 is in a "HIGH" or "ON" state, current is supplied to actuate a spray nozzle solenoid. The solenoid, and thus the spray nozzle, is deactuated when the signal 402 is in a "LOW" or "OFF" state. The duty cycle of the pulse sequence is determined by the width of a pulse P relative to the cycle time. In other words, the duty cycle D may be determined by taking the ratio of the ON time $t_{ON}$ and the cycle time $t_{TOT}$. The cycle time $t_{TOT}$ is, of course, the sum of the ON time $t_{ON}$ and the OFF time $t_{OFF}$. Thus, the duty cycle D may be defined as $D=t_{ON}/t_{TOT}=t_{ON}/(t_{ON}+t_{OFF})$.

In order to adjust the spray output of the spray dampener, the duty cycle of the signal 402 may be varied. A higher duty cycle would increase the spray output from the dampener. For example, a duty cycle of 1 would mean that the signal 402 stayed in the ON position at all times and, thus, the spray nozzles would likewise remain ON at all times. The spray nozzles would remain in an OFF state for a duty cycle of 0. In the particular signal 402 illustrated in FIG. 14, the pulse width $t_{ON}$ is roughly one-third of the total cycle time $t_{TOT}$. Hence, the duty cycle for the illustrative signal 402 in FIG. 14 would be approximately 0.33, and a spray nozzle controlled by the signal would be ON roughly 33.3% of operating time.

The duty cycle may be varied by changing one or both of the pulse width $t_{ON}$ on the time $t_{OFF}$ between adjacent pulses of the pulse sequence defined by the signal 402. In a typical spray dampener, however, system limitations often prevent proper operation of the spray dampener beyond particular operating parameters. For instance, in systems which vary the duty cycle by varying the width of a pulse, valve and nozzle limitations prevent proper operation for pulse widths below a certain value. Thus, systems which vary ON time often suffer from poor spray patterns during periods in which spray output is low. Similarly, systems which vary the duty cycle by adjusting OFF time confront problems associated with roller drying when relatively long periods of time elapse between spray pulses, particularly during high speed press operation. The present invention, however, overcomes these difficulties.

Figure 15:
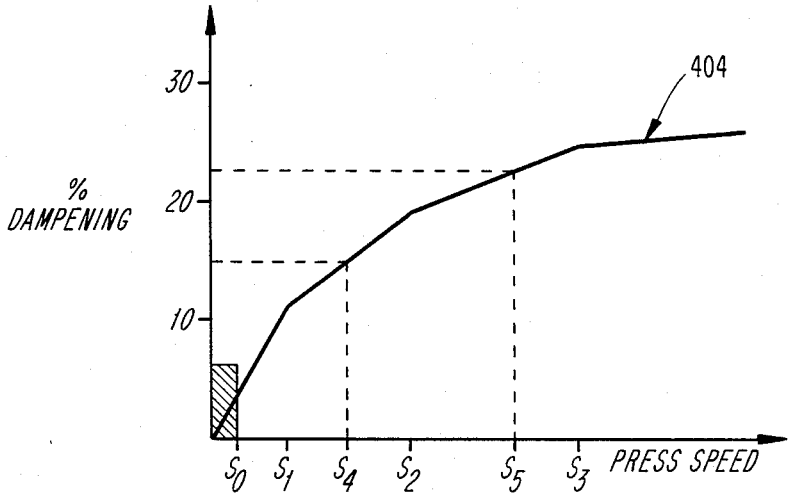
FIG. 15 illustrates a dampening curve for correlating press speed to spray nozzle operation parameters.

Referring to the dampening curve of FIG. 15, the amount of dampening fluid dispensed by the spray dampener preferably has a nonlinear relationship to press speed. At press speeds below a certain speed $S_0$, spray dampener output may be inhibited. This situation normally would occur as the press was being brought up to printing speed. As illustrated with dampening curve 404, between speed $S_0$ and speed $S_1$, the dampening percentage, i.e., the percentage of time during which the nozzles release dampening fluid, increases linearly with press speed at a first rate. Likewise, between press speeds $S_1$ and $S_2$, between press speeds $S_2$ and $S_3$, and above speed $S_3$, the dampening percentage varies linearly with press speed at different rates. If desired, the dampening curve may include a purge signal which would output when the printing press is initially brought to speed $s_0$. The speeds at which the dampening curve 404 encounters a change in slope, and the particular slopes for the individual segments of the dampening curve will depend on the printing press in which the spray dampening system is used.

In accordance with one feature of the present invention, when the press speed is below speed $S_2$, the pulse width $t_{ON}$ of nozzle control pulses P is set at a predetermined value, e.g., 20 microseconds, which is sufficiently long to ensure a proper spray pattern. The dampening percentage may then be varied by adjusting the time period between adjacent pulses in the pulse sequence. When the press speed is above speed $S_2$, the time period between adjacent pulses is set at a predetermined value, e.g., 400 microseconds, which ensures that the printing press rollers will not dry excessively between pulses of spray during high speed press operation. The dampening percentage is then varied by adjusting the pulse width of the pulses P. In this way, the present invention obtains proper spray patterns and effective operation throughout a broad range of operating conditions.

In another embodiment of the present invention, the pulse width between speeds $S_0$ and $S_1$, may be set at a first value, for example 20 microseconds, and the pulse width between speeds $S_1$ and $S_2$, when dampening requirements are higher, may be set at a higher second value such as 30 microseconds. Similarly, the time period between adjacent pulses of the pulse sequence for press speeds between speeds $S_2$ and $S_3$ may be set at one value, for example, 500 microseconds, and at another value such as 400 microseconds for press speeds above speed $S_3$. Thus, finer spray control is provided by adding additional set points along the dampening curve 404. Of course, if desired even more set points could be provided on the dampening curve to permit even finer spray control.

Figure 16:
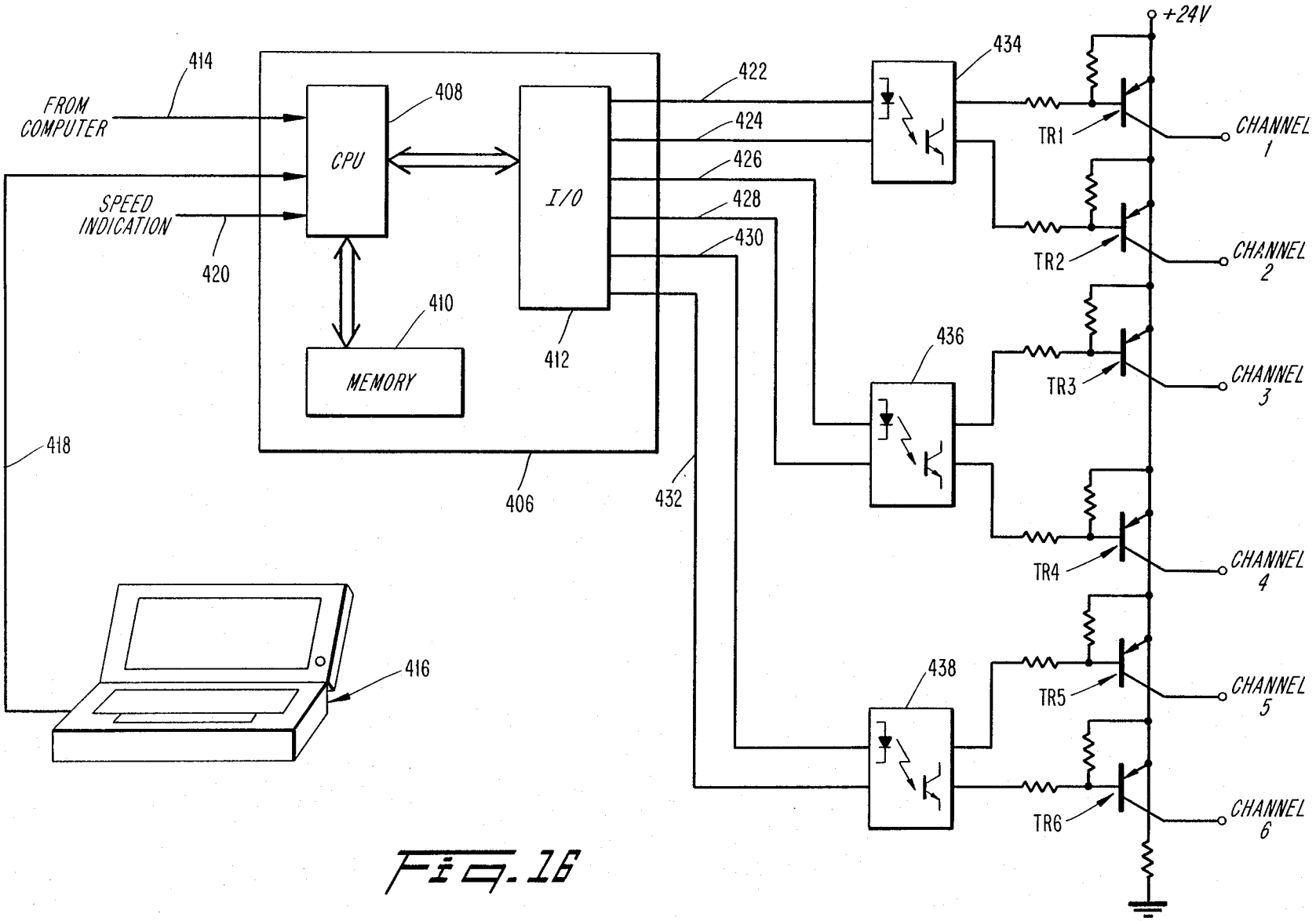
FIG. 16 is a schematic drawing of one embodiment of a spray dampener control system in accordance with the present invention.

Turning now to FIG. 16, a control system in accordance with the present invention includes a main controller 406 including a central processing unit (CPU) 408, a system memory 410, and an input/output (I/O) device 412. Additionally, a display device (not shown) such as a liquid crystal display, a light emitting diode (LED) display, or a cathode ray tube (CRT) may be provided to permit information concerning operating parameters and the like to be conveyed to a user. The system memory 410 preferably includes a non-volatile memory portion for storing one or more dampening curves.

Dampening curves may be preprogrammed into the system memory 410 or, preferably, the dampening curves may be downloaded from a computer or from a terminal device. For this purpose, a serial communications line 414 is provided to permit the controller 406 to communicate with a computer. Additionally, a terminal device 416 may communicate with the controller 406 through a communication line 418. Thus, the characteristics of the dampening curve, which will usually vary between presses, may be tailored to the particular application in which the spray dampener is used.

In operation, if the dampening curve information is stored in a computer, this information may be downloaded to the controller 406 through an appropriate serial interface, such as a standard RS 422 interface. This information may be supplied to CPU 408 for storage in the system memory 410. Preferably, for this purpose, the system memory 410 includes a programmable read-only memory device (PROM). Alternatively, the dampening curve information may be supplied to the CPU 408 from a terminal device 416. Thus, if desired a user can directly store an appropriate dampening curve in the system memory 410.

The CPU 408 is adapted to receive a press speed indication signal on an input line 420. The press speed indication signal may be obtained from a standard tachometer generator, Hall effect proximity sensor or other appropriate sensor. Additionally, in modern printing presses which include a printing computer, a press speed indication signal might already be available in the press computer. In this case, the press speed indication signal may be obtained directly from the printing computer.

The CPU 408, in response to the speed indication signal, retrieves a record from the system memory 410 which contains information relating to the parameters of a spray nozzle actuation control signal. For instance, the speed indication signal might be converted into a memory address value. The contents stored in the system memory 410 at this address might then provide information indicating a duty cycle value for the spray nozzle actuation control signal. Based upon the stored duty cycle value and the speed indication signal, the parameters of the spray nozzle actuation signal may be calculated by the CPU 408.

For example, referring again to FIG. 15, if a speed-indication signal indicating a speed $S_4$ is obtained by the main controller 406, a record stored in system memory 410 in the appropriate memory location would including a duty cycle value 0.15 corresponding to 15% dampening. Since speed $S_4$ is lower than speed $S_2$, the pulse width $t_{ON}$ is set at a fixed value such as 20 microseconds. As discussed above, the duty cycle D may be expressed as $D=t_{ON}/(t_{ON}+t_{OFF})$. Solving for $t_{OFF}$, we obtain $t_{OFF}=t_{ON}*(1-D)/D$. Thus, $t_{OFF}=20*(1-0.15)/0.15=113$ microseconds. If a particular press speed value called for 6% dampening, $t_{OFF}$ would be 313 microseconds.

The pulse sequence parameters may similarly be calculated when the press speed value obtained by the main controller 406 is greater than speed $S_2$. For example, for press speed $S_5$, the appropriate memory location in system memory 410 would contain a record including a duty cycle value 0.22. Using a fixed time period of 400 microseconds between pulses, the pulse width value $t_{ON}$ may be determined by solving the expression $t_{ON}=-t_{OFF}*(D/(1-D))$. Thus, $t_{ON}$ for speed $S_5$ would be $t_{ON}=400*(0.22/(1-0.22))=113$ microseconds.

When a press speed value corresponds to speed $S_2$, i.e., the speed value at which the pulse sequence changes from using a fixed pulse width to using a fixed time period between adjacent pulses, the main controller 406 may calculate either the pulse width $t_{ON}$ or the time period $t_{OFF}$. Turning back to FIG. 16, once the CPU 408 has determined the parameters of the spray nozzle actuating pulse sequence, the I/O unit 412 is controlled to output pulse sequences to the spray bar. In a preferred manner of forming the pulse sequence from the pulse parameters, the CPU 408 utilizes count values corresponding to the pulse width and the time period between pulses. If the pulse width count value is designated $C_{ON}$ and the count value corresponding to the time period between pulses is designed $C_{OFF}$, the CPU 408 may generate a rectangular pulse sequence by providing a HIGH output signal for $C_{ON}$ clock cycles and a LOW output signal for $C_{OFF}$ clock cycles. Count values $C_{ON}$ and $C_{OFF}$ may themselves be stored in system memory 410 for retrieval by the CPU 408 in response to the press speed indication signal.

Preferably the CPU 408 produces pulse sequences one through six which are output by I/O unit 412 on first through sixth output lines 422, 424, 426, 428, 430 and 432, respectively. Output lines 422 and 424 are connected with the respective channels of a standard dual channel optocoupler 434. Similarly, output lines 426 and 428 are connected with the respective channels of a dual channel optocoupler 436, and output lines 430 and 432 are connected with respective channels of a dual channel optocoupler 438. The optocouplers serve to help isolate the main controller 406 from possible damage caused by transient surges and the like.

Output line 422, after passing through optocoupler 434, controls the operation of a power transistor TR1. Similarly, output line 424 controls the operation of power transistor TR2; output line 426 controls the operation of power transistor TR3; output line 428 controls the operation of power transistor TR4; output line 430 controls the operation of power transistor TR5; and output line 432 controls the operation of power transistor TR6. Thus, the pulse sequences appearing on output lines 422–432 determine the operating states of power transistors TR1–TR6, respectively. In turn, the operating states of transistors TR1–TR6 determine the signals appearing on control channels 1–6, respectively.

Figure 17:
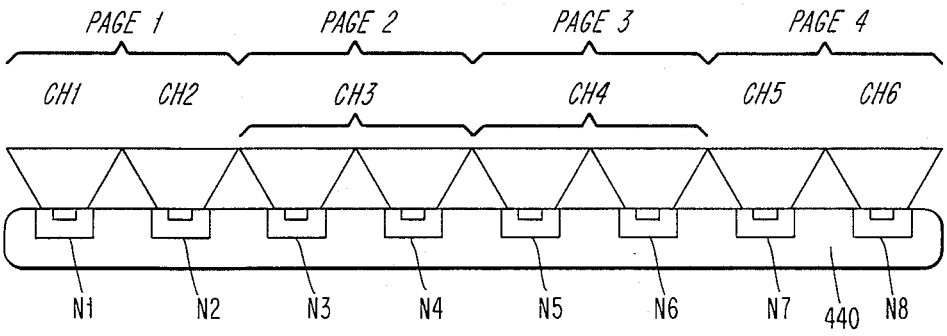
FIG. 17 illustrates the relationships between spray nozzles, control channels, and printed pages in accordance with one feature of the present invention.

Referring to FIG. 17, spray bar 440 may be provided with eight spray nozzles N1–N8 arranged in a linear array. Spray bar 440 is preferably adapted to supply dampening fluid for a multipage printing press. Typically, for example, the spray bar 440 provides dampening fluid for a four page printing press. In such a case, nozzles N1 and N2 primarily control dampening of page 1, nozzles N3 and N4 primarily control dampening of page 2, nozzles N5 and N6 primarily control dampening of page 3, and nozzles N7 and N8 primarily control dampening of page 4. Of course, the spray patterns from adjacent nozzles overlap slightly.

Since end nozzles N1 and N8 are situated at the outermost portions of the linear array of nozzles, there is no dampening contribution from overlapping spray from an adjacent outer nozzle. Thus, the portions of the dampening roller adjacent the outer portions of pages 1 and 4 receive somewhat less dampening fluid than the remaining portions of the roller. The outer portions of the roller, however, often have a greater tendency to heat than the intermediate portions of the roller. Accordingly, the portion of the roller which requires the greatest amount of dampening fluid often receives the least. It has been suggested that this problem may be overcome by using larger spray nozzles on the outer portions of the spray bar. This solution, however, often leads to additional problems associated with the use of differing spray nozzles on the spray bar. Additionally, maintenance and manufacture of the spray bars is complicated by this structure.

According to one feature of the present invention, this shortcoming of prior spray dampening systems has been overcome. As indicated in FIG. 17, nozzle N1 is controlled by channel 1; nozzle N2 is controlled by channel 2; nozzles N3 and N4 are controlled by channel 3; nozzles N5 and N6 are controlled by channel 4; nozzle N7 is controlled by channel 5; and nozzle N8 is controlled by channel 6. In order to compensate for increased heat and reduced dampening at the outer spray nozzles, the duty cycle of the pulse sequences on control channels 1 and 6 may be increased. For example, the duty cycle of the pulse sequence on control channel 1 may be slightly higher than the duty cycle of the pulse sequence on control channel 2. Similarly, the duty cycle of the pulse sequence on control channel 8 may be slightly higher than the duty cycle of the pulse sequence on control channel 7. Preferably the duty cycle of the pulse sequences on control channels 1 and 8 are functionally related to the duty cycle of the pulse sequences on control channels 2 and 7, respectively. In an exemplary embodiment, the duty cycles of the pulse sequences on control channels 1 and 8 are 4% higher than the duty cycles of the pulse sequences on control channels 2 and 7, respectively. In other words, the duty cycle of nozzle N1 will be 1.04 times that of nozzle N2.

Since nozzles N1 and N8 each have a dedicated control channel, the different duty cycles may be accommodated. The CPU 408 may be programmed to calculate the modified duty cycle for nozzles N1 and N8 and adjust the pulse sequences on output lines 422 and 432 accordingly. Dedicated power transistors TR1 and TR8 control nozzles N1 and N8 in accordance with the modified pulse sequences.

Typically, in a multipage printing operation, the printing parameters will vary from page to page. These variances in printing parameters may result in one page requiring additional (or less) dampening fluid. Accordingly, each page is provided with a separate control channel. As illustrated in FIG. 17, nozzles N3 and N4 (page 2) are operated by channel 3. Nozzles N5 and N6 (page 3) are controlled by channel 4. Of course, since outer nozzles N1 and N8 have dedicated control channels, nozzles N2 and N7 also have individual control channels CH2 and CH5, respectively. Again, however, it is noted that the duty cycle of the pulse sequence on channel 1 preferably is functionally related to the duty cycle of the pulse sequence on channel 2, and the duty cycle of the pulse sequence on channel 8 preferably is functionally related to the duty cycle of the pulse sequence on channel 7.

In order to allow greater flexibility in controlling the operation of the spray dampening device, the operating characteristics of the main controller may be varied in accordance with user instructions. Accordingly, user commands may to input to the main controller 406 through terminal 416. Additionally, the main controller 406 may include keypad or specific control knobs (not shown). If, for example, page 2 required increased dampening, a user could instruct the CPU 408 to increase the duty cycle of the pulse sequence on channel 3.

Although the present invention has been described in connection with preferred embodiments thereof, it will be appreciated by those skilled in the art that additions, deletions, modifications and substitutions not specifically described may be made without departing from the spirit and scope of the invention as defined in the appended claims.

What is claimed is:

1. In a printing apparatus comprising a rotary roll and a spray dampener for spraying liquid onto said roll, said spray dampener comprising a plurality of liquid sprayer assemblies spaced along the length of said roll for directing overlapping sprays toward said roll, each sprayer assembly comprising:

valve means, nozzle means including a liquid spray outlet at a front end thereof and a valve seat at a rear end thereof, said nozzle means directed toward said roll, and means releasably mounting said nozzle means to said valve means, said valve means comprising:

a valve housing including a throughbore communicating with a liquid inlet, a solenoid plunger slidably mounted in said throughbore for reciprocable movement therein, and a valve stem removably mounted at a front end of said plunger and including a front sealing surface arranged to contact said valve seat, said valve seat, said valve stem, said plunger, and said nozzle means being coaxially arranged, said valve stem being detachable from said plunger in response to the application of suitable force to a front end of said valve stem, said throughbore being wide enough to permit forward removal of said valve stem from said plunger when said nozzle means is removed from said valve means.

2. Apparatus according to claim 1 including means for intermittently actuating said solenoid plunger to effect a pulsating spray action.

3. Apparatus according to claim 1, wherein said valve stem is mounted to said plunger by friction-fit.

4. Apparatus according to claim 1, wherein said valve stem includes at least one longitudinal channel on its outer periphery for conducting liquid.

5. Apparatus according to claim 1, wherein said nozzle means comprises a nozzle housing having a slitted member inserted therein to define a spray outlet at a front end of said nozzle housing, said valve seat being press-fit in a rear end of said nozzle housing and projecting rearwardly therefrom.

6. Apparatus according to claim 5, wherein said valve seat is rearwardly tapered.

7. Apparatus according to claim 5, wherein said front surface of said valve stem is formed of an elastic material.

8. In a printing apparatus comprising a rotary roll and a spray dampener for spraying liquid onto said roll, said spray dampener comprising a plurality of liquid sprayer assemblies spaced along the length of said roll for directing overlapping sprays toward said roll, each sprayer assembly comprising:

valve means, nozzle means including a nozzle having a liquid outlet at a front end thereof and a valve seat mounted in a rear end thereof, said nozzle means directed toward said roll, and means releasably mounting said nozzle means to said valve means, said valve means comprising:

a valve housing including a throughbore and a liquid inlet communicating with said throughbore, a post extending rearwardly from said throughbore, a solenoid coil mounted on said post, a plunger having a rear end slidably mounted in said post to be reciprocated rearwardly upon energization of said solenoid coil, and a front end slidably disposed in said throughbore, spring means biasing said plunger forwardly, a valve stem removably mounted at a front end of said plunger and carrying an elastic front sealing member arranged to contact said valve seat under the action of said spring means when said solenoid coil is de-energized, said nozzle outlet, said valve seat, said valve stem, said plunger, and said post being coaxially arranged, said valve stem being detachable from said plunger in response to the application of suitable force to a front end of said valve stem, said throughbore being wide enough to permit forward removal of said valve stem from said plunger when said nozzle element is removed from said valve means.

9. Apparatus according to claim 8, wherein said valve stem is mounted to said plunger by a friction-fit.

10. Apparatus according to claim 8, wherein said valve seat tapers rearwardly.

11. Apparatus according to claim 8, wherein said sealing member of said valve stem is flat.

12. In a printing apparatus comprising a rotary roll and a spray dampener for spraying liquid onto said roll, said spray dampener comprising a plurality of liquid sprayer assemblies spaced along the length of said roll for directing overlapping sprays toward said roll, each sprayer assembly comprising:

valve means, nozzle means including a nozzle having a liquid outlet at a front end thereof and a valve seat mounted in a rear end thereof, said nozzle means directed toward said roll, and means releasably mounting said nozzle means to said valve means, said valve means comprising:

a valve housing including a throughbore communicating with a liquid inlet, and reciprocable means slidably mounted in said throughbore for reciprocable movement therein and including a front sealing surface arranged to contact said valve seat, said valve seat, said reciprocable means, and said nozzle means being coaxially arranged, said nozzle means comprising:

a hollow nozzle housing, a nozzle element formed of a hard material and disposed at a front end of said nozzle housing, said nozzle element including a slit defining a spray outlet, a retaining ring mounted behind said nozzle element, and said valve seat being mounted within said retaining ring and projecting rearwardly therefrom.

13. Apparatus according to claim 12, wherein said valve seat is press-fit within said retaining ring.

14. Apparatus according to claim 12, wherein said front sealing surface is flat and is of larger diameter than a fluid passage extending through said valve seat.

* * * * *